US009147349B2

(12) United States Patent
Maddanimath et al.

(10) Patent No.: US 9,147,349 B2
(45) Date of Patent: Sep. 29, 2015

(54) SYSTEM AND METHOD FOR INCREASING SITUATIONAL AWARENESS BY CORRELATING INTRUDER AIRCRAFT ON A LATERAL MAP DISPLAY AND A VERTICAL SITUATION DISPLAY

(71) Applicant: HONEYWELL INTERNATIONAL INC., Morristown, NJ (US)

(72) Inventors: Shivashankar Veerayya Maddanimath, Bangalore (IN); Vinod Singh, Bangalore (IN); Satish Pindikoor, Koppal (IN); Devesh Choubey, Bhopal (IN)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 323 days.

(21) Appl. No.: 13/651,033

(22) Filed: Oct. 12, 2012

(65) Prior Publication Data

US 2014/0104080 A1 Apr. 17, 2014

(51) Int. Cl.

| | |
|---|---|
| ***G08B 21/00*** | (2006.01) |
| ***G08G 5/00*** | (2006.01) |
| ***G08G 5/04*** | (2006.01) |

(52) U.S. Cl.

CPC ..... *G08G 5/0021* (2013.01); *G08G 5/0078* (2013.01); *G08G 5/045* (2013.01)

(58) Field of Classification Search

CPC .... G08G 5/0021; G08G 5/0078; G08G 5/045
USPC ..... 340/945, 961, 963; 342/29
See application file for complete search history.

(56) References Cited

U.S. PATENT DOCUMENTS

| | | | | |
|---|---|---|---|---|
| 5,179,377 | A * | 1/1993 | Hancock | 340/961 |
| 5,202,690 | A | 4/1993 | Frederick | |
| 6,271,768 | B1 * | 8/2001 | Frazier et al. | 340/961 |
| 6,381,519 | B1 | 4/2002 | Snyder | |
| 6,433,729 | B1 * | 8/2002 | Staggs | 342/29 |
| 6,930,617 | B2 | 8/2005 | Chamas et al. | |
| 7,495,601 | B2 | 2/2009 | Blaskovich et al. | |
| 7,646,313 | B2 | 1/2010 | Winkler et al. | |
| 8,068,039 | B2 | 11/2011 | Cole et al. | |
| 2002/0075171 | A1 | 6/2002 | Kuntman et al. | |
| 2003/0137444 | A1 * | 7/2003 | Stone et al. | 342/30 |
| 2006/0227012 | A1 | 10/2006 | He | |
| 2007/0252749 | A1 | 11/2007 | Blaskovich et al. | |
| 2010/0315265 | A1 * | 12/2010 | Smith et al. | 340/963 |
| 2011/0006918 | A1 | 1/2011 | Shafaat et al. | |
| 2011/0193725 | A1 * | 8/2011 | Wise et al. | 340/974 |
| 2011/0316857 | A1 | 12/2011 | Pepitone et al. | |

OTHER PUBLICATIONS

EP Examination Report for Application No. EP 13185794.8 dated Jul. 15, 2014.
EP Search Report for Application No. 13 185 794.8 dated Feb. 28, 2014.
EP Exam Report for Application No. 13 185 794.8 dated Mar. 12, 2014.

* cited by examiner

*Primary Examiner* — Mark Rushing
(74) *Attorney, Agent, or Firm* — Ingrassia Fisher & Lorenz, P.C.

(57) ABSTRACT

A system and method for displaying a first intruder aircraft symbology on a lateral map display and on a vertical situation display is provided. Symbology is generated that is graphically representative of the first intruder aircraft on the lateral map display and the VSD. Additional symbology is generated to correlate the first intruder aircraft on the lateral map display to that on the vertical situation display.

4 Claims, 10 Drawing Sheets

SYSTEM AND METHOD FOR INCREASING SITUATIONAL AWARENESS BY CORRELATING INTRUDER AIRCRAFT ON A LATERAL MAP DISPLAY AND A VERTICAL SITUATION DISPLAY

TECHNICAL FIELD

Embodiments described herein relate generally to vehicular display systems and, more particularly, to an avionics display system and method for visually expressing three-dimensional informational data on a two-dimensional lateral map display (LMAP) display and a vertical situation display (VSD) thus increasing a pilot's situational awareness.

Avionics display systems deployed aboard aircraft has been extensively engineered to visually convey a considerable amount of flight information in an intuitive and readily comprehendible manner. In conventional avionics display systems, the majority of the information visually expressed on a display, such as a primary flight display, pertains to the host aircraft's flight parameters (e.g., the heading, drift, roll, and pitch of the host aircraft), nearby geographical features (e.g., mountain peaks, runways, etc.), and current weather conditions (e.g., developing storm cells). Aside from a neighboring aircraft's current detected position, conventional avionics display systems typically provide little visual information pertaining to neighboring aircraft. This may be due, in part, to current air traffic management ("ATM") practices wherein air traffic management is generally managed by personnel stationed within air traffic controllers and other ground-based control facilities. However, conventional control facility-based ATM systems are inherently limited in the volume of air traffic that they can effectively manage during a given time period. For this reason, the United States has commenced the development and implementation of a modernized ATM system (commonly referred to as the "Next Generation Air Transportation System" or, more simply, "NextGen") in which air traffic management will be largely handled by individual flight crews utilizing data compiled from a constellation of computerized systems on satellites and neighboring aircraft. Europe has similarly begun the development and implementation of a similar program commonly referred to as the "Single European Sky ATM Research," or "SESAR," program.

In view of the above described trend toward aircrew-centric traffic management, it is desirable to provide an avionics display system and method for visually expressing additional flight characteristics pertaining to neighboring aircraft. These flight characteristics may include enhanced three-dimensional awareness of traffic in the vicinity of a host aircraft and displayed on an LMAP display and a VSD. This is especially important in the case, for example, when intruder symbols are superimposed on either the LMAP or VSD display.

Considering the foregoing, it would be desirable to provide a system and method for correlating intruder symbols appearing on the LMAP display and the VSD so as to enhance situational awareness by facilitating the identification of intruder aircraft vertically as well as laterally thus enabling the crew to identify the correct position of intruder aircraft and take whatever action may be appropriate.

Other desirable features will become apparent from the following detailed description and the appended claims, taken in conjunction with the accompanying drawings and this background.

BRIEF SUMMARY

This summary is provided to introduce a selection of concepts in a simplified form that are further described below in the detailed description. This summary is not intended to identify key or essential features of the claimed subject matter, nor is it intended to be used as an aid in determining the scope of the appended claims.

A method for displaying a first intruder aircraft symbology on a lateral map display and on a VSD is provided. Symbology is generated that is graphically representative of the first intruder aircraft on the lateral map display and the VSD. The first intruder aircraft is correlated on both the lateral map display and on the VSD.

An aircraft display system that displays intruder aircraft symbology on a lateral map display is also provided. The system comprises a monitor, a user input device for selecting a first intruder symbol on one of the lateral map display and the VSD, and a processor coupled to the monitor and to the user input device and configured to correlate the first intruder on both the lateral map display and the VSD.

In addition, there is provided a method for graphically representing at least a first intruder on a lateral map (LMAP) display and on a vertical situation display (VSD). The method first determines if there are hidden intruders beneath the first intruder in one of the LMAP and VSD displays. Next, an indication of the number of hidden intruders is graphically rendered adjacent the first intruder symbol. The number of hidden intruders in one of the LMAP display and the VSD are sequentially correlated to associate them with their respective counterparts in the other of the LMAP display and the VSD.

BRIEF DESCRIPTION OF THE DRAWINGS

A more complete understanding of the subject matter may be derived by referring to the detailed description and claims when considered in conjunction with the following figures, wherein like reference numerals refer to similar elements throughout the figures, and wherein:

DETAILED DESCRIPTION

The following Detailed Description is merely exemplary in nature and is not intended to limit the invention or the application and uses of the invention. Furthermore, there is no intention to be bound by any theory presented in the preceding Background or the following detailed description.

Figure 1:
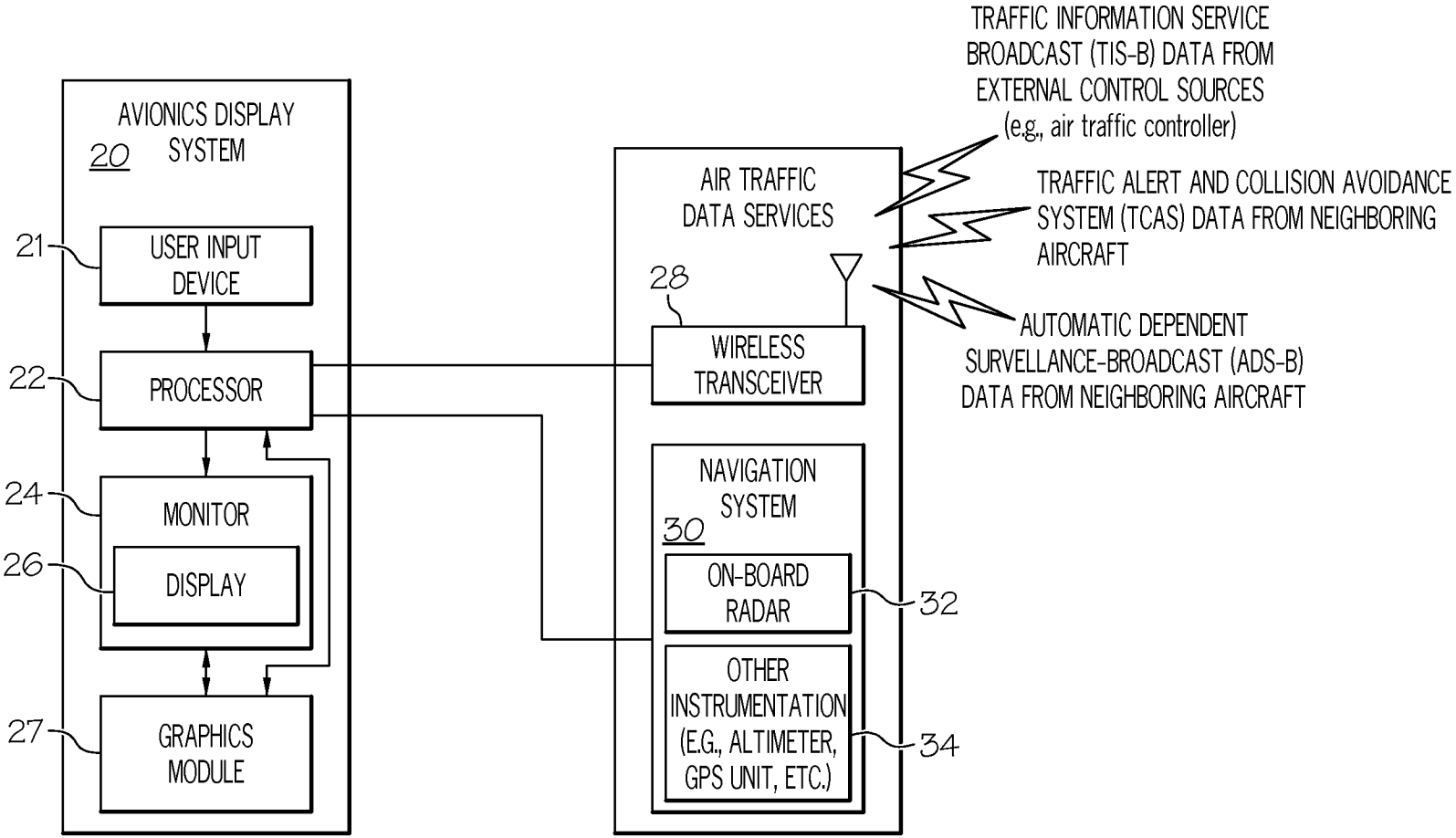
FIG. 1 is functional block diagram of a generalized avionics display system in accordance with an exemplary embodiment.

FIG. 1 is a functional block diagram of a generalized avionics display system 20 in accordance with an exemplary embodiment. Avionics display system 20 includes at least one processor 22 and at least one monitor 24, which is operatively coupled to processor 22. During operation of avionics display system 20, processor 22 drives graphics module 27 which, in conjunction with processor 22, drives monitor 24 to produce a graphical display 26 that visually provides a pilot and crew with information pertaining to the host aircraft and to neighboring aircraft within a predetermined vicinity of the host aircraft. Graphical display 26 may include visual representations of one or more of flight characteristics pertaining to a neighboring aircraft, as described more fully below. Processor 22 may generate display 26 in a two dimensional format (e.g., as a lateral or vertical profile map display) or in a hybrid format (e.g., in a picture-in-picture or split screen arrangement) and may be incorporated into all units capable of displaying TCAS data; e.g. the primary flight display, the multifunction display, and the interactive navigation display.

Processor 22 may comprise, or be associated with, any suitable number of individual microprocessors, flight control computers, navigational equipment, memories, power supplies, storage devices, interface cards, and other standard components known in the art. In this respect, the processor 22 may include or cooperate with any number of software programs (e.g., avionics display programs) or instructions designed to carry out the various methods, process tasks, calculations, and control/display functions described below, for example, processor 22 may be included within a Flight Management Computer of the type commonly deployed within a Flight Management System (FMS).

Image-generating devices suitable for use as monitor 24 include various analog (e.g., cathode ray tube) and digital (e.g., liquid crystal, active matrix, plasma, etc.) display devices. In certain embodiments, monitor 24 may assume the form of a Head-Down Display (HDD) or a Head-Up Display (HUD) included within an aircraft's Electronic Flight Instrument System (EFIS). Monitor 24 may be disposed at various locations throughout the cockpit. For example, monitor 24 may comprise a primary flight display (PFD) and reside at a central location within the pilot's primary field-of-view. Alternatively, monitor 24 may comprise a secondary flight deck display, such as an Engine Instrument and Crew Advisory System (EICAS) display, mounted at a location for convenient observation by the aircraft crew but that generally resides outside of the pilot's primary field-of-view. In still further embodiments, monitor 24 may be worn by one or more members of the flight crew.

Processor 22 includes one or more inputs operatively coupled to one or more air traffic data sources. During operation of display system 20, the air traffic data sources continually provide processor 22 with navigational data pertaining to neighboring aircraft. In the exemplary embodiment illustrated in FIG. 1, the air traffic data sources include a wireless transceiver 28 and a navigation system 30, which are operatively coupled to first and second inputs of processor 22, respectively. Navigation system 30 includes onboard radar 32 and various other onboard instrumentation 34 such as a radio altimeter, a barometric altimeter, a global positioning system (GPS) unit, and the like. In a preferred embodiment, navigation system 30 may be included within a FMS; and onboard radar 32 may be included within a Terrain Awareness and Warning System (TAWS), such as an Enhanced Ground Proximity Warning System (EGPWS).

With continued reference to FIG. 1, wireless transceiver 28 is considered an air traffic data source in that transceiver 28 receives navigational data from external control sources and relays this data to processor 22. For example, wireless transceiver 28 may receive Traffic Information Services-Broadcast (TIS-B) data from external control sources. In a preferred embodiment wireless transceiver 28 receives Traffic Collision Avoidance System (TCAS) data, and may receive Automatic Dependent Surveillance-Broadcast (ADS-B) data from neighboring aircraft. This data, and other such external source data, is formatted to include air traffic information, which may be utilized to determine a neighboring aircraft's current position and the existence and location of air traffic.

TCAS is an airborne system that detects and tracks aircraft near a host aircraft. TCAS includes a processor, antennas, a traffic display (e.g. an LMAP display, a VSD, etc.), and means for controlling the system, such as is shown in FIG. 1. The processor and antennas detect and track other aircraft (known as intruders) by interrogating their transponders, and tracking these intruders on a display. The TCAS processor analyzes the transponder replies to determined range, bearing and relative altitude. If the system determines that a potential hazard exists, it issues visual and aural advisories to the crew. The visual advisory takes the form of symbols on the one or more traffic displays; e.g. the LMAP display and VSD. The system identifies the relative threat of each intruder using various symbols and colors. The intruder's altitude relative to that of the host aircraft is annunciated if the intruder is reporting altitude, and a trend arrow is used to indicate if the intruder is climbing or descending at a rate greater than 500 feet per minute.

The intruder's response to interrogation enables the TCAS system to determine the (1) range between the host aircraft and the intruder, (2) the relative bearing to the intruder, (3) the altitude and vertical speed to the intruder if the intruder is reporting altitude, and (4) the closing rate between the intruder and the host aircraft. Using this data, the system can predict the time to, and the separation at, the intruder's closest point of approach. If the system predicts that certain safe boundaries may be violated, it will issue a Traffic Advisory (TA) to alert the crew that closing traffic is nearby.

As stated previously, visual advisories, in the form of for example three symbols are displayed on one of the LMAP and a VSD displays. The specific symbol type is dependent upon the intruder's location and closing rate. The symbols change shape and color as separation between the intruder and the host aircraft decreases so as to represent increasing levels of concern.

The significance of an intruder symbol on a display may be gleaned from the shape and/or color of the symbol. For example, if an intruder is considered non-threat or other traffic, it is represented graphically as a white or cyan, unfilled diamond on the display. If the intruder aircraft is within six nautical miles and has a relative altitude of ±1,200 feet, the intruder is considered proximate traffic and is represented graphically as a solid, white or cyan filled diamond on the display. An intruder of this type is still not considered a threat and is displayed to assist the pilot in visually acquiring the intruder. A yellow-filled circle is used to display intruders that have caused a traffic advisory (TA) to be issued. A TA assists the pilot to visually acquire the intruder aircraft and prepares the pilot for a potential resolution advisory (RA). An RA is displayed as a red filled square.

As referred to previously, a vertical motion arrow in the same color as the intruder symbol and pointing upward or downward is placed on the right side of the symbol to indicate if the intruder is climbing or descending at a rate greater than 500 feet per minute. In addition, the intruder's relative altitude is displayed as a decimal number in units of hundreds of feet and is placed on the right side of the intruder symbol. The color is the same as the intruder symbol. If the intruder is above the host, the altitude is displayed with a plus (+) sign. If below the host, the altitude is displayed with a minus (−) sign. No altitude readout is displayed if the relative altitude is zero. In addition, a distance decimal number representing the distance in miles between the host and the intruder may be displayed above the intruder symbol. The distance is displayed in the same color as the intruder symbol.

Figure 2:
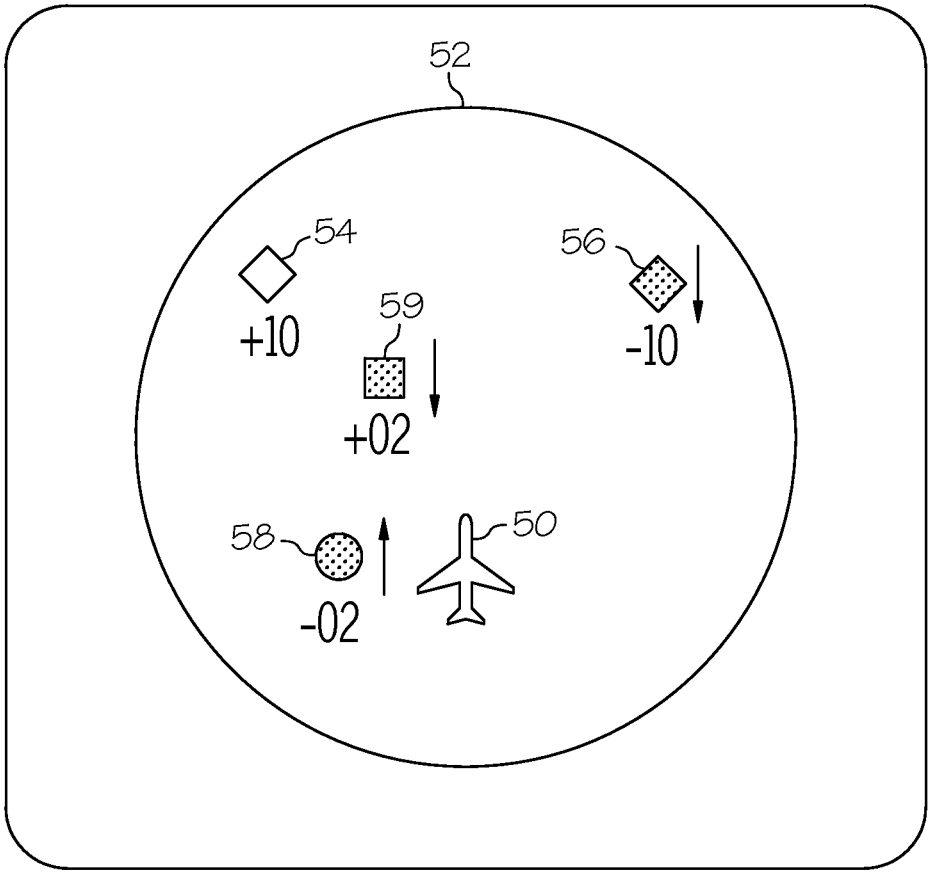
FIG. 2 is a simplified snapshot of a two dimensional LMAP display that may be generated on the display included in the avionics display system shown in FIG. 1.

FIG. 2 illustrates a simplified LMAP display graphically representing a host aircraft 50 and a five-nautical-mile range ring 52. Other traffic (OT) 54 is represented by an unfilled, white or cyan diamond 54 flying at an altitude of one-thousand feet above the host aircraft 50. Proximate traffic (PT) 56 at an altitude of one-thousand feet below host aircraft 50 and descending is graphically represented as white or cyan filled (represented by stippling throughout the figures) diamond 56. A traffic advisory (TA) 58 two-hundred feet below host aircraft 50 and climbing is represented by filled circle 58. Finally, a resolution advisory (RA) 59 at an altitude of 200 feet above host aircraft 50 and descending is graphically represented as a filled square.

Figure 3:
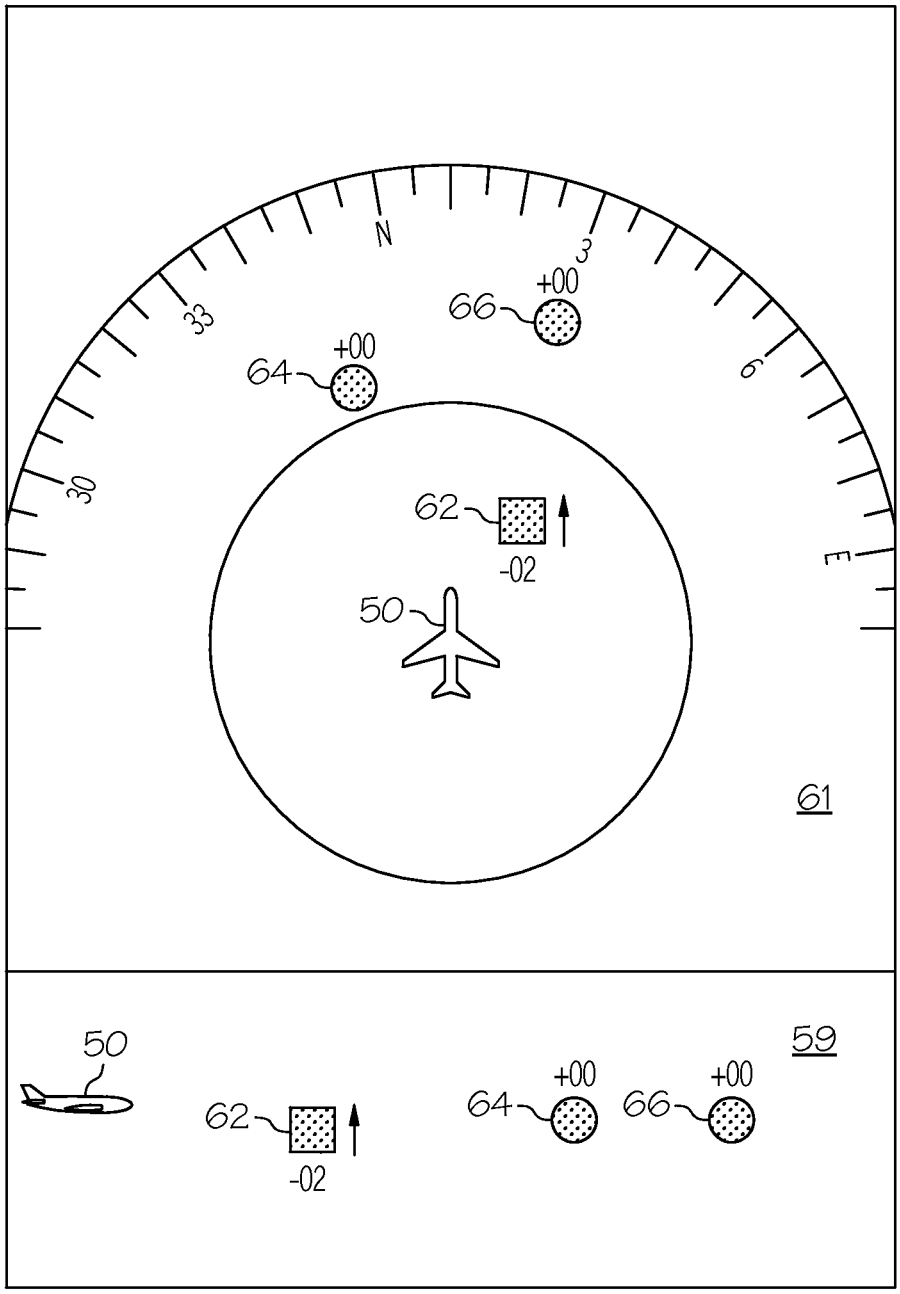
FIG. 3 is a graphical representation of a simplified VSD display illustrating the vertical situation of a host aircraft.

While an LMAP display of the type shown in FIG. 2 provides horizontal situational awareness to a pilot, a VSD provides vertical situational awareness in a similar manner. For example, FIG. 3 is a graphical representation of a simplified VSD 59 illustrating the vertical situation of host aircraft 50 on an LMAP display 61. As can be seen, a first resolution advisory (RA) intruder 62 is 200 feet below host aircraft 50, and is climbing. In addition, first and second traffic advisory (TA) intruders 64 and 66 are flying at substantially the same altitude as host aircraft 50.

One of the major benefits of a VSD is improved safety, especially with respect to early threat recognition, effectiveness when flying steep approaches, and maintenance of a stabilized path. It provides the crew with an intuitive view of the vertical situation just as the LMAP display provides an intuitive depiction of the horizontal situation. Thus, the crew can access the vertical situation quickly, reducing overall workload.

Figure 4:
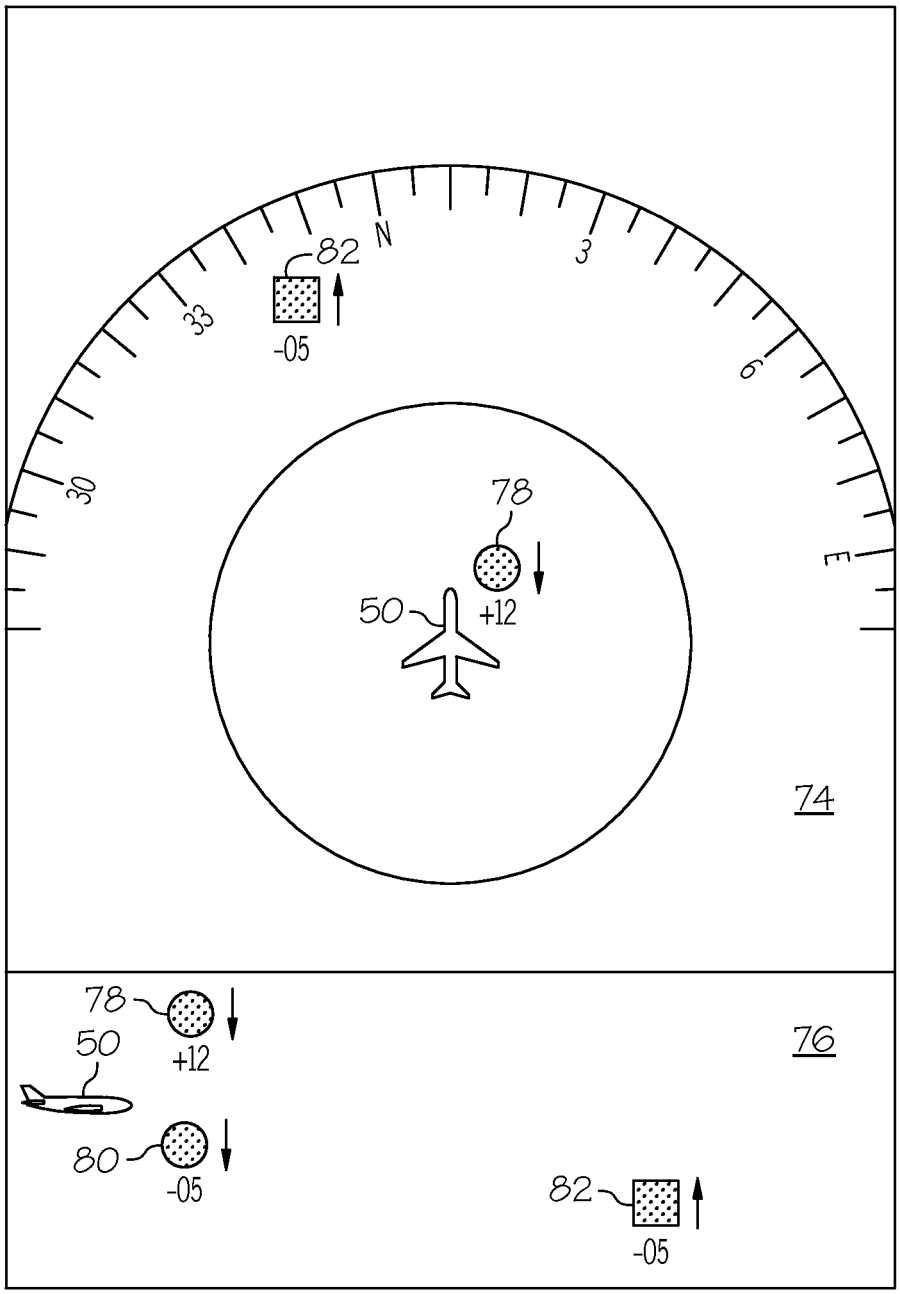
FIG. 4 is a graphical representation of a TCAS display comprised of an upper LMAP section and a lower VSD window.

In current TCAS systems, intruders are displayed, as previously described, on an LMAP display and a VSD. Referring to FIG. 4, there is shown a graphical representation of a TCAS display comprised of an upper LMAP section 74 and a lower VSD 76 graphically representing three intruders 78, 80, and 82; however, the LMAP 74 shows only intruders 78 and 82 because intruder 80, while visible in VSD 76, is hidden beneath intruder 78 in LMAP display 74, perhaps creating potential confusion and reducing situational awareness. Thus, intruders may be superimposed on (1) the VSD when they are at the same altitude but at different latitude-longitude values, and (2) on the LMAP display when intruders are at the same latitude-longitude but at different altitudes. Therefore, embodiments disclosed herein contemplate correlating intruder symbols appearing on the LMAP display and the VSD to enhance the situational awareness of the crew by providing easy identification of intruders vertically as well as laterally using currently used LMAP and VSD displays and thus avoiding ambiguity. It is further contemplated that the same intruder will be highlighted on the LMAP and the VSD displays for RA, TA, OT, and PT traffic to provide enhanced situational awareness around the host aircraft. It is still further contemplated that embodiments disclosed herein will highlight the same intruder on the LMAP and VSD displays by hovering a cursor on the intruder in either display and selecting (clicking on) the intruder (i.e. a cursor selection event) to highlight the intruder in both displays when they are in the visible range of their respective displays.

Figure 5:
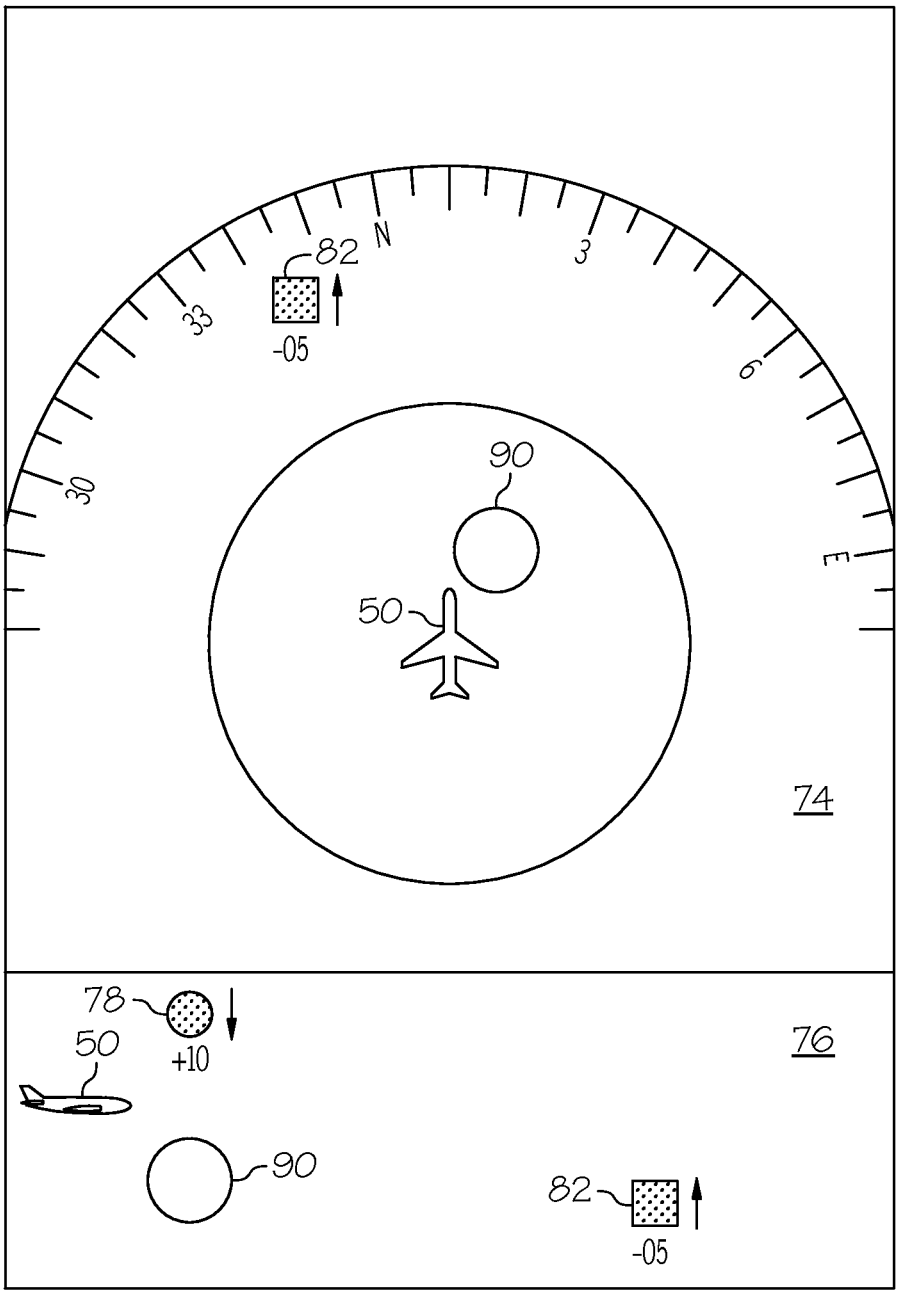
FIGS. 5-9 are graphical representations of TCAS displays illustrating various methodologies for highlighting associated intruder aircraft in both the LMAP and VSD displays.

Referring now to FIG. 5, the ambiguity referred to in FIG. 4 is resolved by performing a cursor selection event on intruder 80 in the VSD. This results in the correlation of intruder 80 with the corresponding intruder 80 that is hidden beneath intruder 78. In this case, the intruder is highlighted with a highlighted region 90 that covers intruder 80 in both displays. In this manner, the crew is informed that intruders 78 and 80 are stacked in LMAP display 74 such that symbology corresponding to the intruder 80 is not visible on LMAP display 74. It should be noted that while highlighted regions 90 are shown as circular, they may have other shapes (e.g. the shape of intruder symbol) and may also be colored (e.g. having the same color as that of the intruder symbol over which it is disposed).

Thus, correlation between intruder symbols in this scenario can be achieved by (1) placing a cursor on an intruder symbol on either the LMAP or VSD, (2) clicking (i.e. selecting) on the intruder, and (3) selecting a graphical function that highlights the intruder and corresponding intruders on the other display. That is, if the pilot places the cursor on an intruder on the LMAP display and clicks the cursor control, the same intruder on the VSD will also be highlighted. Similarly, a pilot can see the horizontal position of an intruder displayed on the VSD, by placing the cursor on the intruder symbol on the LMAP display and clicking to highlight the intruder on the LMAP display.

Figure 6:
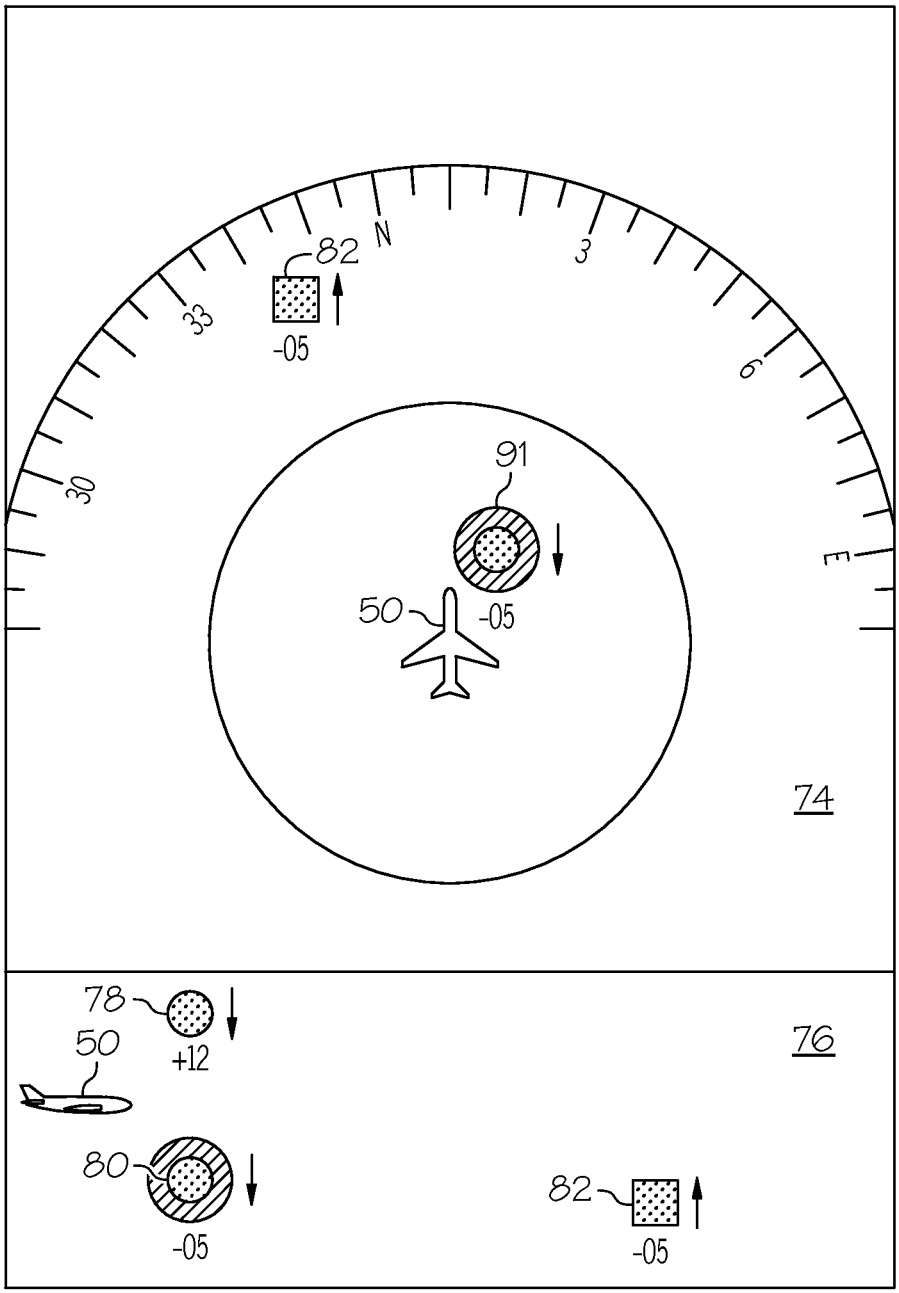
Figure 7:
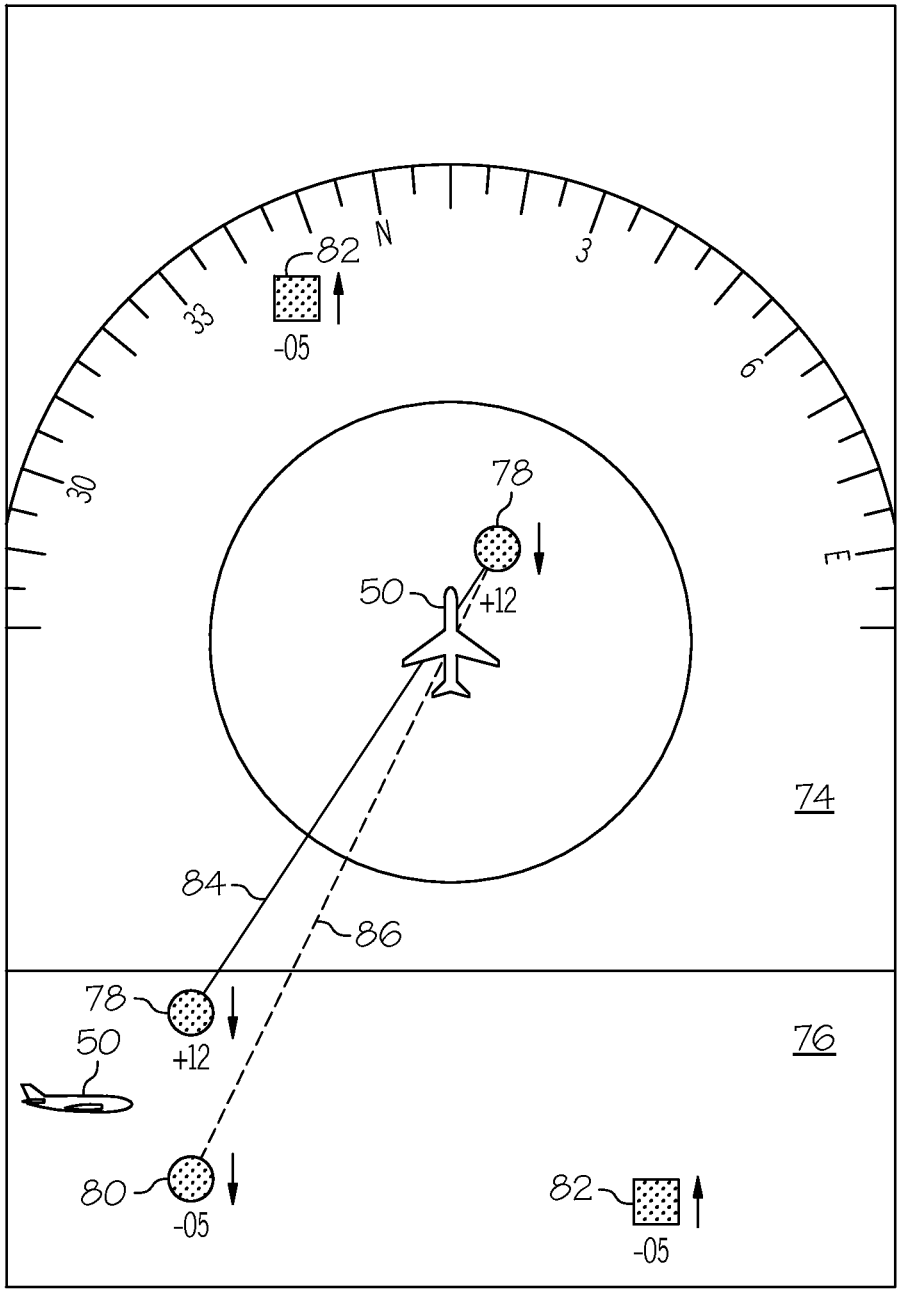
Figure 8:
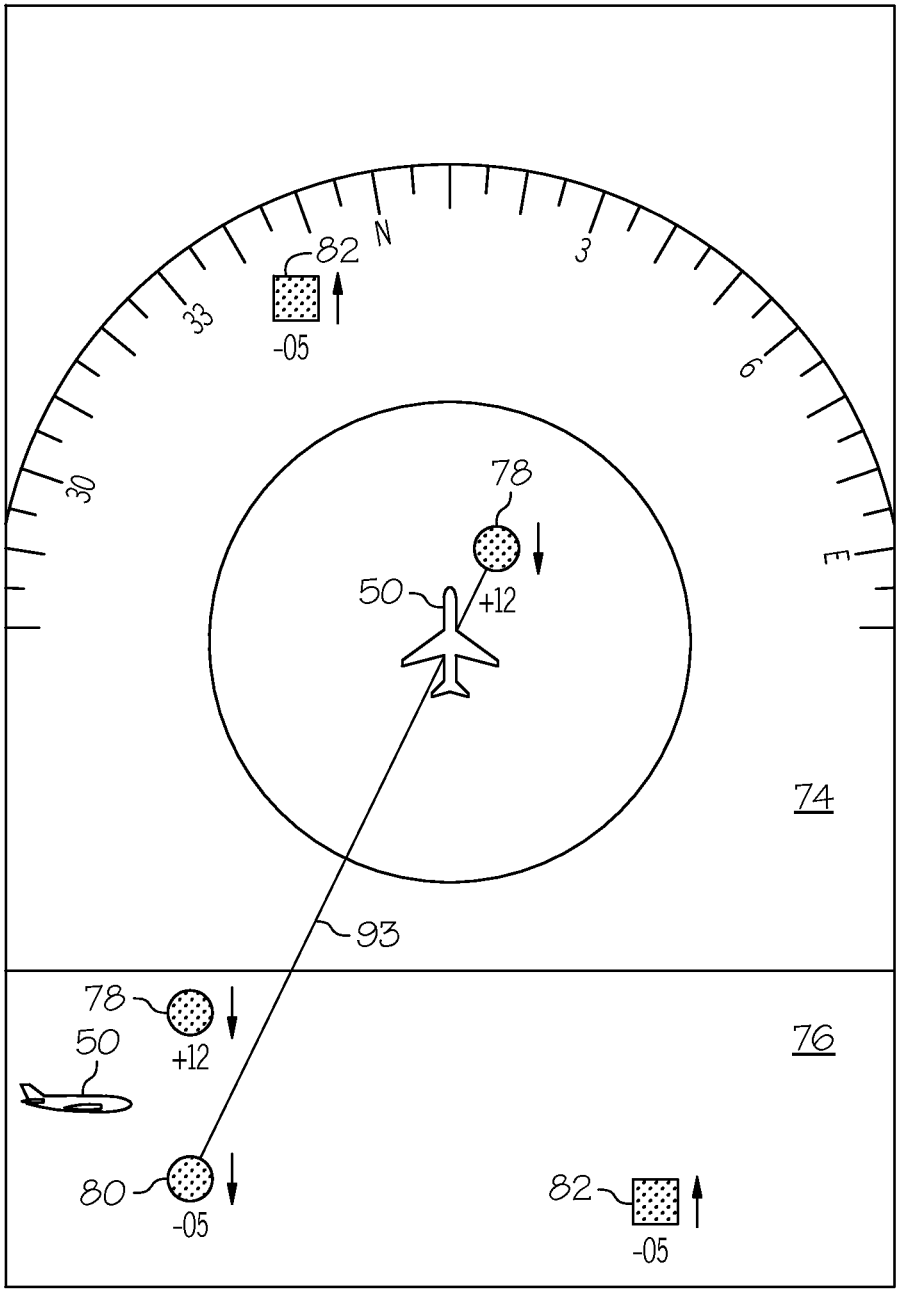

As previously described, corresponding intruders displayed on the LMAP display and the VSD may be graphically highlighted with filled circles over the location of intruders of the same color as the intruder (FIG. 5). Alternatively, the circles may be semi-transparent as shown at 91 in FIG. 6. In yet another example, the intruders may be highlighted with a graphical representation of lines extending from the selected intruder symbol in one of the displays and extending to its corresponding intruder symbols in the other display. For example, referring to FIG. 7, after selecting intruder 78 in the LMAP display, a line 84 is generated and displayed extending from intruder 78 on the LMAP display to intruder 78 on the VSD. A line 86 is also generated extending from intruder symbol 78 on the LMAP display 74 to intruder 80 on the VSD that is hidden beneath the symbol corresponding to intruder 78 on the LMAP display. The lines may be generated similarly or may be distinguishable in color, thickness, or style (solid, dashed, etc.). Color may be based on the color of the intruder symbol. For example, line 84 is shown as solid, and line 86 is shown as dashed. If the pilot has initially selected intruder symbol 80 in the VSD, a single line 93 having a color and style (solid, dashed, etc.) corresponding to the color and style of the intruder symbol would be rendered between intruder 80 and intruder 78 on the LMAP display as shown in FIG. 8.

Alternatively, corresponding intruder symbols may be highlighted by displaying flight identification symbology proximate to the respective intruder symbols in the LMAP display 74 and the VSD 76. For example, referring to FIG. 9, the flight identification indicia PACI 5752 is displayed alongside intruder 78 in both displays. The flight identification indicia may be displayed in the same color as the intruder and, if desired, may flash or blink.

Figure 9:
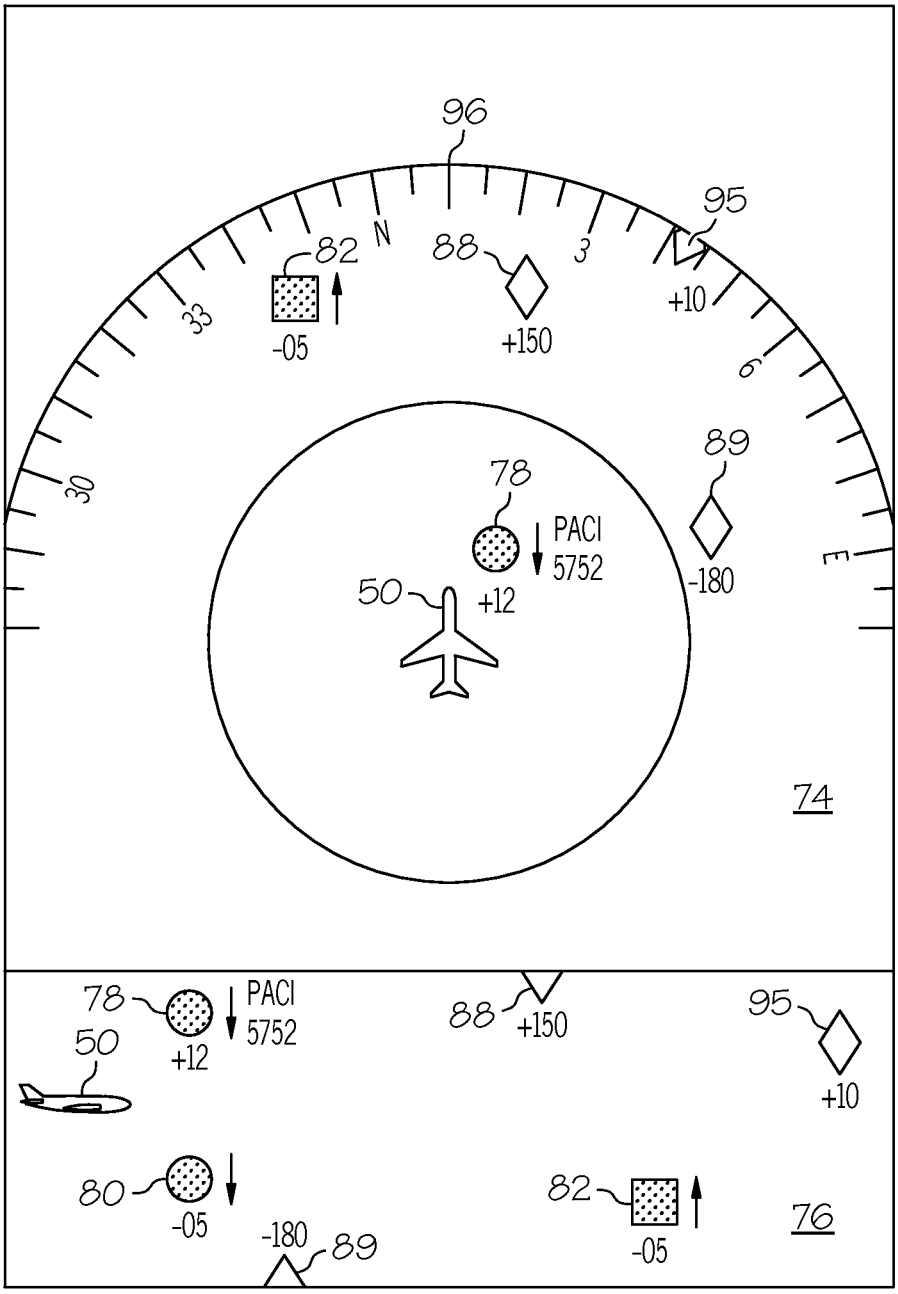

In accordance with a further embodiment, if a given intruder can be seen in the LMAP display but not in the VSD because its altitude is beyond the range of the VSD, half of the intruder symbol may be graphically represented at the upper edge of the vertical display if it is above the host aircraft and at the lower edge if it is below the host aircraft. For example, referring again to FIG. 9, intruders 88 and 89 on LMAP display 74 are above and below, respectively, host aircraft 50 and beyond the vertical range of VSD 76. Therefore, half of their respective symbols are displayed on the VSD as shown in FIG. 9. Similarly, if a given intruder (e.g. 95) can be seen in the VSD but not on the LMAP display because the range of the LMAP display is set lower than that of the VSD (i.e. the intruder is out of range on the LMAP display), half of the intruder will be displayed at the edge of the outer range ring 96 in the direction of the intruder 95 from the host aircraft 50 as shown in FIG. 9.

Figure 10:
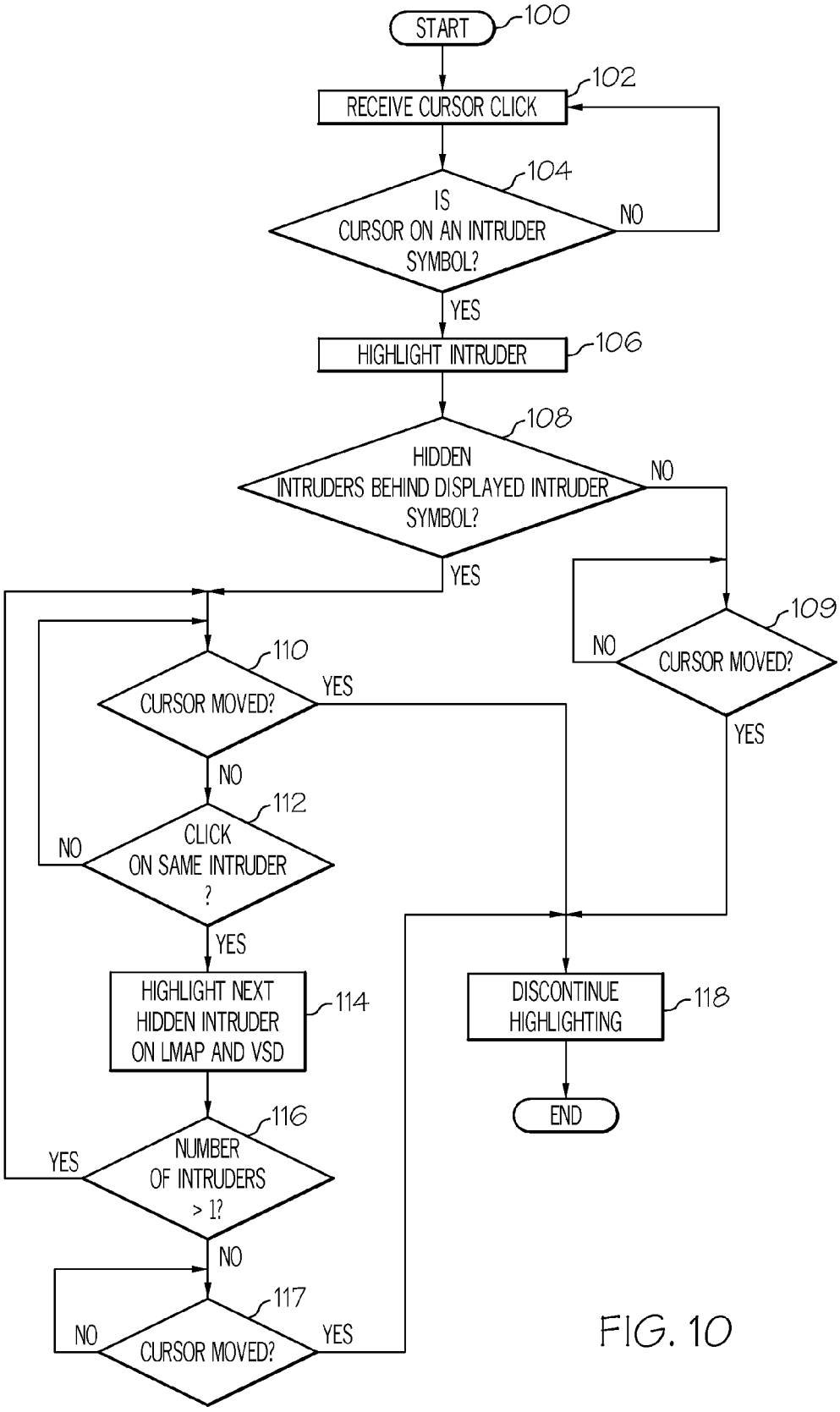
FIG. 10 is a flowchart illustrating an exemplary process that may be performed by the avionics display system shown in FIG. 1 for correlating and highlighting associated hidden intruders in both displays.

FIG. 10 is a flowchart describing a process 100 for carrying out the above described operations. When a user input event, in this a cursor click event generated via user input device 21 (FIG. 1), is received (STEP 102), it is first determined if the cursor is hovering on an intruder symbol (STEP 104). If the cursor is hovering over a visible intruder symbol, the symbol is highlighted (STEP 106) on both the LMAP display and VSD as previously described. Next, processor 22 determines if any intruders are hidden below the visible intruder (STEP 108). If not, a subsequent change in cursor position will result in removal of the highlighting on both displays (STEP 109).

If it is determined that there are intruders hidden under the visible intruder symbol (STEP 108), and if the cursor is moved (STEP 110), highlighting is removed in both views. If the cursor is not moved (STEP 110) and there is another cursor click event (STEP 112), the next intruder is displayed and highlighted (STEP 114) on both displays as previously described. Processor 22 next determines if the number of hidden intruders is greater than one (STEP 116). If so, STEPS 110, 112, 114, and 116 are repeated. If there are no hidden intruders left to be displayed, highlighting will be discontinued upon further movement of the cursor (STEP 117) off the intruder symbol (STEP 118).

The order for highlighting hidden intruders on the LMAP display may be governed by the severity of the threat. For example, RA threats would be displayed followed by TA, followed by PT, and finally OT. Within a given threat category, priority may be based on relative altitude with respect to the host aircraft; i.e. the intruder with the lowest relative altitude is the first to be highlighted. When the cycle is completed, the first intruder reappears on the next cursor click event. On the VSD, the order of highlighting may be based on the severity of threat as was the case above. Within a given threat category, it may be left-to-right, right-to-left, or based by user choice and selection.

Thus, there has been provided a system and method for correlating intruder symbols appearing on the LMAP display and the VSD technology so as to enhance situational awareness by facilitating the identification of intruder aircraft vertically as well as laterally using current LMAP and VSDs, thus enabling the crew to identify the correct position of intruder aircraft and take whatever action may be appropriate.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims.

What is claimed is:

1. A method for displaying a first intruder aircraft symbology on a lateral map (LMAP) display and on a vertical situation display (VSD), comprising:

receiving navigational data pertaining to a first intruder aircraft;

rendering symbology graphically representative of the first intruder aircraft on the LMAP display and the VSD;

in response to receiving, from a user input device, a selection of the first intruder aircraft on one of 1) the lateral map display (LMAP) and 2) the VSD, highlighting the first intruder aircraft on the LMAP display and on the VSD;

determining a number of intruders hidden behind the first intruder; and displaying indicia adjacent to the first intruder symbol indicative of the number of intruders hidden behind the first intruder.

2. The method of to claim 1 further comprising sequencing through each of the hidden intruders by each time selecting the then visible intruder.

3. The method of to claim 2, wherein each of the hidden intruders is sequenced in the order of least relative altitude with respect to the host aircraft.

4. The method of to claim 2, wherein each of the hidden intruders is sequenced in the order of seriousness of threat to the host aircraft.

* * * * *